US006025835A

United States Patent [19]

Aoki et al.

[11] Patent Number: 6,025,835

[45] Date of Patent: Feb. 15, 2000

[54] DRIVING CIRCUIT FOR DISPLAY APPARATUS WITH PAIRED SAMPLE-HOLD CIRCUITS SAMPLING POSITIVE AND NEGATIVE PHASE PICTURE SIGNAL COMPONENTS FOR COLUMN ELECTRODE DRIVING

[75] Inventors: Yoshiro Aoki; Hajime Sato, both of Yokohama, Japan

[73] Assignee: Kabushiki Kaisha Toshiba, Kawasaki, Japan

[21] Appl. No.: 08/645,766

[22] Filed: May 14, 1996

[30] Foreign Application Priority Data

May 15, 1995 [JP] Japan ..... 7-115613

[51] Int. Cl.[7] ..... G09G 3/36; G09G 5/00

[52] U.S. Cl. ..... 345/204; 345/96; 345/99; 345/100; 345/209

[58] Field of Search ..... 345/50–54, 87–100; 348/790, 791, 792, 793, 751

[56] References Cited

U.S. PATENT DOCUMENTS

| | | | |
|---|---|---|---|
| 4,630,122 | 12/1986 | Morokawa . | |
| 5,017,914 | 5/1991 | Uchida et al. . | |
| 5,051,739 | 9/1991 | Hayashida et al. . | |
| 5,091,784 | 2/1992 | Someya et al. . | |
| 5,166,670 | 11/1992 | Takeda et al. . | |
| 5,252,957 | 10/1993 | Itakura | 345/98 |
| 5,283,565 | 2/1994 | Suzuki et al. | 345/98 |
| 5,436,635 | 7/1995 | Takahara et al. | 345/92 |
| 5,602,561 | 2/1997 | Kawaguchi et al. | 345/99 |
| 5,614,962 | 3/1997 | Nagae et al. | 348/751 |
| 5,616,936 | 4/1997 | Misawa et al. | 345/99 |

FOREIGN PATENT DOCUMENTS 3-51887 3/1991 Japan .

*Primary Examiner*—Bipin Shalwala
*Assistant Examiner*—David L. Lewis
*Attorney, Agent, or Firm*—Pillsbury Madison & Sutro

[57] ABSTRACT

A first common line for supplying a positive phase picture signal and a second common line for supplying a negative phase picture signal are disclosed. A plurality of first switch devices are connected to the first common line. A plurality of second switch devices are connected to the second common line. Each of the first switch devices and each of the second switch devices are paired and connected to one signal line. A first operational amplifier is disclosed between each of the first switch devices and the signal line. The first operational amplifier operates in common with the first switch device group. A second operational amplifier is disclosed between each of the second switch devices and the signal line. The second operational amplifier operates in common with the second switch device group. A common control signal is input from a timing control circuit to the pair of each of the first switch devices and each of the second switch devices. A picture signal is output from the first switch device or the second switch device that is enabled by the first or second operational amplifier.

17 Claims, 9 Drawing Sheets

DRIVING CIRCUIT FOR DISPLAY APPARATUS WITH PAIRED SAMPLE-HOLD CIRCUITS SAMPLING POSITIVE AND NEGATIVE PHASE PICTURE SIGNAL COMPONENTS FOR COLUMN ELECTRODE DRIVING

BACKGROUND OF THE INVENTION

1. Field of the Invention

The present invention relates to a display apparatus such as an active matrix type liquid crystal display apparatus and a driving circuit for driving the display apparatus. In particular, the present invention relates to a display apparatus for AC driving signal lines and pixel electrodes in a display region and a driving circuit thereof.

2. Description of the Related Art

Liquid crystal display apparatuses have been widely used as display devices for TV sets and graphics display devices due to their advantageous features of thin structure and low power consumption. Among them, since an active matrix type liquid crystal display apparatus using thin film transistors (referred to as TFTs) as switching devices have high speed response characteristic and a high precision characteristic, this apparatus is becoming attractive for its high picture quality, large size, and color pictures.

When a DC voltage is supplied to a liquid crystal pixel of a liquid crystal display apparatus, the liquid crystal material deteriorates and the liquid crystal pixel bakes. In addition, the display quality deteriorates due to an adverse effect of a capacitance caused between signal lines and pixel electrodes. Thus, to solve these problems, it is necessary to supply a positive phase picture signal and a negative phase picture signal that alternately vary to each liquid crystal pixel.

However, in the conventional liquid crystal display apparatus, since the positive phase picture signal and the negative phase picture signal are supplied with the same line, when the positive phase picture signal is switched to the negative phase picture signal, the electric charges in the line should be discharged until the negative phase picture signal is obtained. Thus, the power consumption of the external picture signal supplying circuit of the AC driving circuit is larger than that of the non-AC driving circuit.

To solve this problem, a method for supplying a positive phase picture signal from one end of a signal line and a negative phase picture signal from the other end of the signal line has been proposed in Japanese Patent Laid-Open Publication No. 3-51887.

However, in this method, since buffers are disposed at input terminals of a picture signal at both ends of a signal line, only one of the positive phase picture signal and the negative phase picture signal is supplied to one signal line. Thus, when the performance of the switching devices is low (namely, the ON resistance is high or the write time is short), the same phase voltage should be supplied to both ends of one signal line. In this case, this method cannot be used.

SUMMARY OF THE INVENTION

The present invention is made from the above-described point of view.

A first object of the present invention is to provide a driving circuit for driving a display apparatus where the driving circuit can drive the display apparatus by AC with a low power consumption and by supply voltages with the same phase to both ends of a signal line and a display apparatus therewith.

A second object of the present invention is to provide a driving circuit for driving a display apparatus that can accomplish the first object with a simple structure and a display apparatus therewith.

A third object of the present invention is to provide a driving circuit for driving a display apparatus where the driving circuit can accomplish a high quality display performance free of uneven pictures and a display apparatus therewith.

A fourth object of the present invention is to provide a driving circuit for driving a display apparatus of which the driving circuit can decrease an occurrence of a penetration voltage that takes place when a MOS transistor is used as a switching device and a display apparatus therewith.

A fifth object of the present invention is to provide a driving circuit for driving a display apparatus where the driving circuit can be fabricated with a simple fabrication process and a simple structure and a display apparatus therewith.

To accomplish the above-described objects, the present invention is a driving circuit for driving a display apparatus, comprising a first common line and a second common line to which picture signals are input, a first switch device group connected to the first common line and adapted for sampling a picture signal, a second switch device group connected to the second common line and adapted for sampling a picture signal, a timing generating circuit for controlling switching operations for the first switch device group and the second switch device group, a first output enable means in common with the first switch device group, and a second output enable means in common with the second switch device group, wherein a common control signal is input from the timing generating circuit to a pair of switch devices having a first switch device and a second switch device, a picture signal being output from one of the first switch device and the second switch device enabled by the first output enable means or the second enable means.

The present invention is a driving circuit for driving a display apparatus, comprising a first common line and a second common line to which picture signals are input, a first switch device group connected to the first common line and adapted for sampling a picture signal, a second switch device group connected to the second common line and adapted for sampling a picture signal, a timing generating circuit for controlling switching operations for the first switch device group and the second switch device group, a first output enable means in common with the first switch device group, a second output enable means in common with the second switch device group, and a plurality of display signal lines disposed corresponding to each of pairs of the first switch devices and the second switch devices and a plurality of pixels connected thereto, wherein a common control signal is input from the timing generating circuit to a pair of switch devices having a first switch device and a second switch device, a picture signal being output from a switch device enabled by the first output enable means or the second enable means.

According to the present invention, the drive amplitude of a picture signal supplied from the outside is smaller than the drive amplitude in the case that a positive phase picture signal and a negative phase picture signal are supplied with the same line. Thus, the power consumption of the external picture signal supplying circuit can be reduced at least to the level in the case that the picture signals are not AC driven. In addition, since the first output enable means and the second output enable means are disposed, a positive phase picture signal and a negative phase picture signal can be written to upper and lower ends of a signal line. Thus, when the ON resistance of a switching device, such as a sampling hold circuit, is high or the write time is not long, the load for driving the signal line can be substantially halved.

The difference between the ON resistance and the OFF resistance when a positive phase picture signal and a negative phase picture signal are supplied can be minimized. In addition, the difference of the level shift voltage between the positive phase and the negative phase can be minimized. (In other words, although the difference between the ON resistance and the OFF resistance and the difference in the penetration resistance between the positive phase picture signal and the negative phase picture signal logically becomes 0, a very small error that can be omitted may be present.)

Moreover, both a positive phase picture signal and a negative phase picture signal can be written to a signal line in a region of which the ON resistance is low. Thus, these picture signals can be effectively held in a region where the OFF resistance is high. Consequently, pictures can be prevented from being unevenly displayed.

Furthermore, since the first capacitor and the second capacitor are disposed, when the gate of the MOS transistor is turned off, electric charges with the inverse polarity of the level shift voltage can be supplied from the capacitors connected to the signal line. Thus, the level shift voltage that takes place in the MOS transistor used as a switching device can be decreased.

In addition to the above-described operations, the first switching device and the second switching device can be formed on the same substrate as the switching device of the pixel portion (namely, on a so-called array substrate of a switching device) in the same process as the switching device of the pixel portion while the switching device is being formed. Thus, the fabrication process and the structure of the circuit and the apparatus can be simplified.

These and other objects, features and advantages of the present invention will become more apparent in light of the following detailed description of best mode embodiments thereof, as illustrated in the accompanying drawings.

DETAILED OF THE PREFERRED EMBODIMENTS

Next, with reference to the accompanying drawings, embodiments of the present invention will be described.

Figure 1:
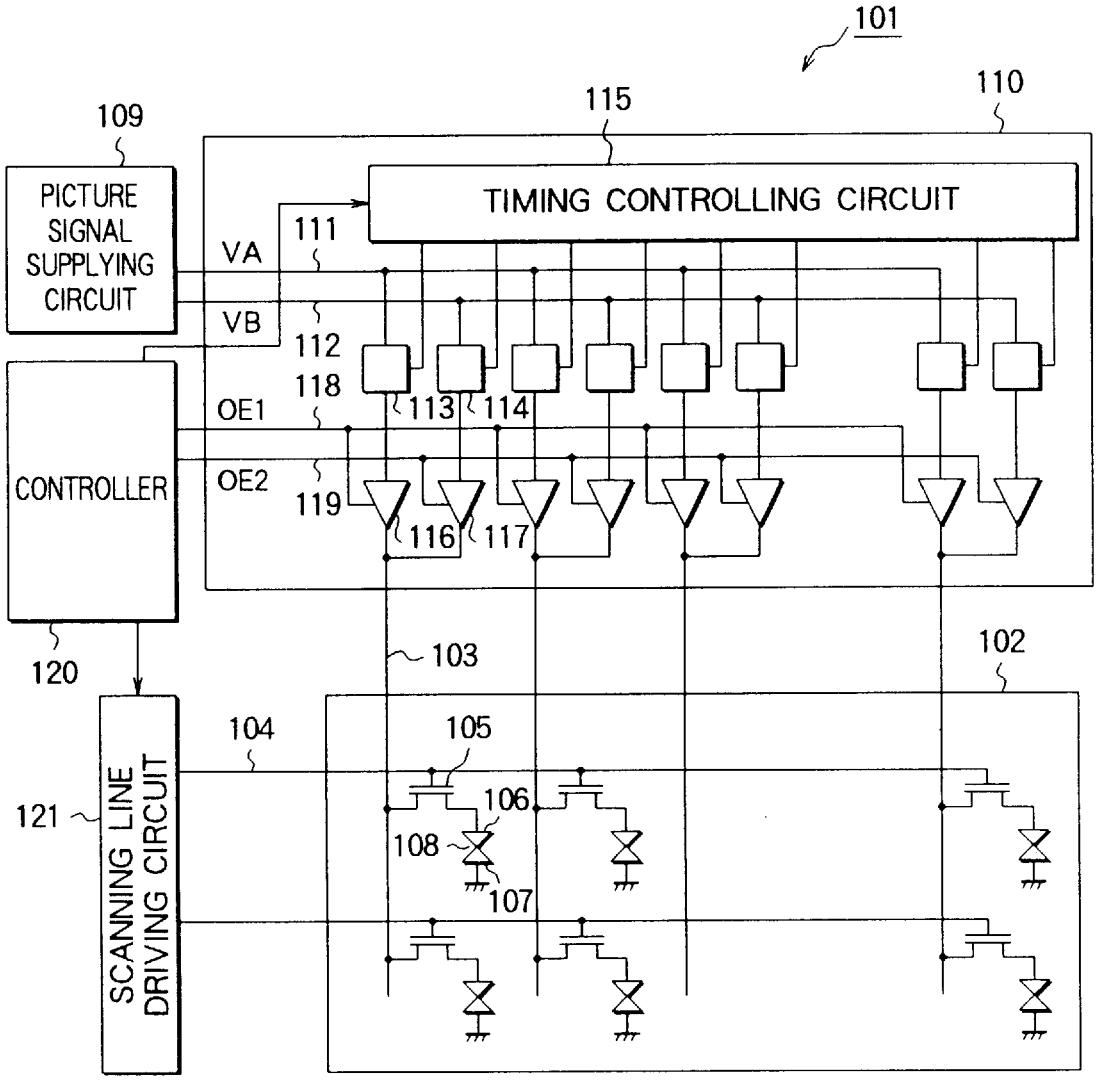
FIG. 1 is a block diagram showing an outlined electric structure of a liquid crystal display apparatus according to a first embodiment of the present invention.

FIG. 1 is a block diagram showing an outlined electric structure of a liquid crystal display apparatus according to a first embodiment of the present invention.

As shown in FIG. 1, signal lines 103 and scanning lines 104 are disposed in a display region 102 of a liquid crystal display device 101. The signal lines 103 and the scanning lines 104 intersect in the vertical and horizontal directions in a matrix shape. At each intersection portion of the lines 103 and 104, a TFT 105 is formed as a switching device of a pixel portion. A pixel electrode 106 is connected to the TFT 105. The voltage supplied to the pixel electrode 106 is controlled corresponding to the switching operation of the TFT 105. For example, an opposite electrode 107 is grounded. Thus, the voltage of the pixel electrode 106 is supplied to the liquid crystal pixel 108 as a liquid crystal supplying voltage.

A picture signal supplying circuit 109 supplies a picture signal to a signal line driving circuit 110. The picture signal is separated into a positive phase picture signal and a negative phase picture signal and supplied to the signal line driving circuit 110 through lines 111 and 112, respectively. The positive phase picture signal and the negative phase picture signal are supplied to sample-hold circuits 113 and 114 in the signal line driving circuit 110. For example, the positive phase picture signal and the negative phase picture signal are supplied to the sample-hold circuit 113 and the sample-hold circuit 114, respectively. The sample-hold circuits 113 and 114 hold picture signals corresponding to a control signal received from a timing controlling circuit 115.

The two adjacent sample-hold circuits 113 and 114 corresponding to the positive phase picture signal and the negative phase picture signal are connected to the signal line 103 through operational amplifiers 116 and 117, respectively. The operational amplifiers 116 and 117 are connected to other lines 118 and 119, respectively. The line 118 connected to the operational amplifier 116 corresponds to, with for example, the line 111 connected to the sample-hold circuit 113. The line 119 connected to the operational amplifier 117 corresponds to for example, the line 112 connected to the sample-hold circuit 114. Control terminals of the lines 118 and 119 are connected to a controlling circuit 120. The controlling circuit 120 controls the ON/OFF states of the operational amplifiers 116 and 117 through lines 118 and 119, respectively. The controlling circuit 120 controls a scanning line driving circuit 121 connected to the timing controlling circuit 115 and the line 104.

Figure 2:
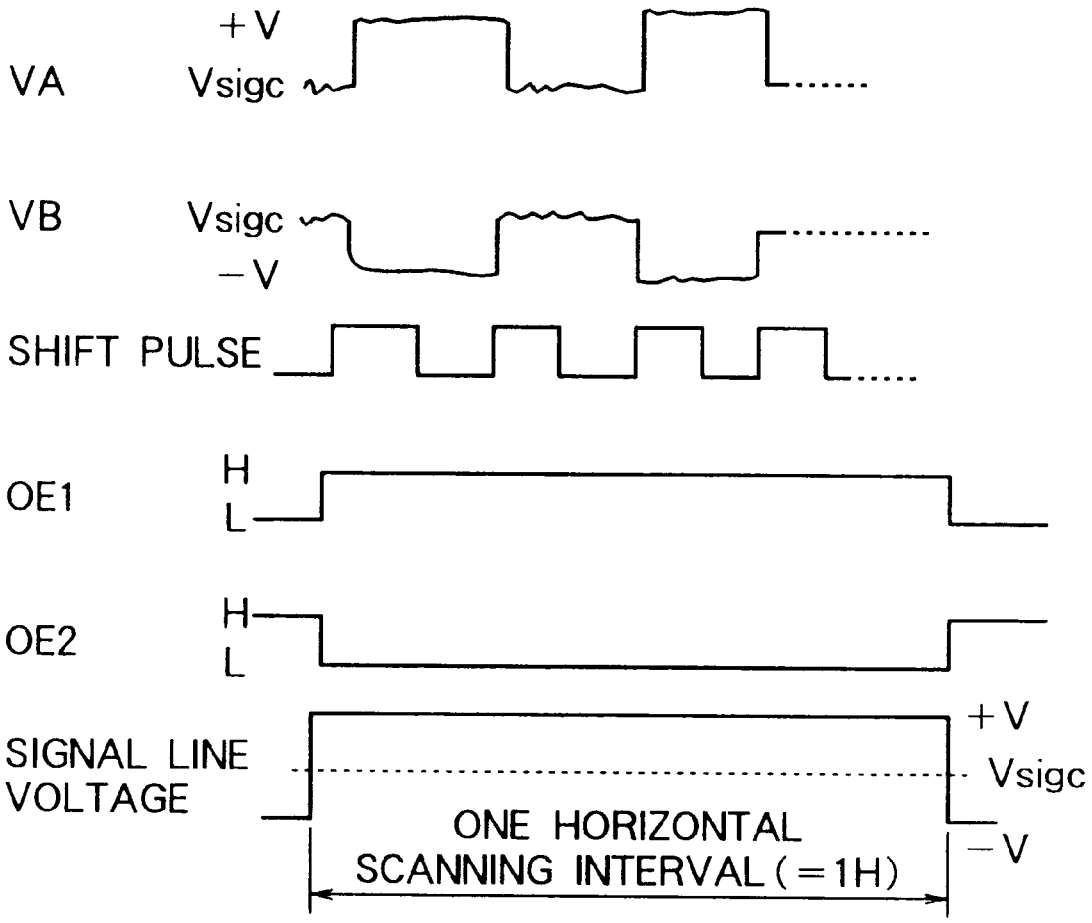
FIG. 2 is a timing chart of various signals of the liquid crystal display apparatus according to the first embodiment of the present invention.

FIG. 2 is a timing chart of various signals of the liquid crystal display apparatus.

In FIG. 2, VA is a positive phase picture signal supplied from the picture signal supplying circuit 109 to the sample-hold circuit 113 through the line 111. VB is a negative phase picture signal supplied from the picture signal supplying circuit 109 to the sample-hold circuit 114 through the line 112. Shift pulse is a control signal supplied from the timing controlling circuit 115 to the sample-hold circuits 113 and 114. OE1 is an output enable signal supplied from the controlling circuit 120 to the operational amplifier 116 through the line 118. OE2 is an output enable signal supplied from the controlling circuit 120 to the operational amplifier 117 through the line 119. Signal line voltage is a voltage of a picture signal supplied to the signal line 103.

A positive phase picture signal and a negative phase picture signal are supplied to the sample-hold circuits 113 and 114 at predetermined periods, respectively. When a shift pulse becomes high, the positive phase picture signal and the negative phase picture signal are held.

For each horizontal scanning interval, the signal level of the output enable signal supplied to the operational amplifiers 116 and 117 is switched. When the signal level of the output enable signal supplied to the operational amplifier 116 is high, the signal level of the output enable signal supplied to the operational amplifier 117 becomes low. When the signal level of the output enable signal supplied to the operational amplifier 116 is low, the signal level of the output enable signal supplied to the operational amplifier 117 becomes high.

The writing operation of the positive phase picture signal and the negative phase picture signal to the signal line 103 is switched every horizontal scanning interval. Thus, the picture signal voltage is supplied to the pixel electrode 106 through the signal line 103 of the display region 102. Consequently, the liquid crystal pixel 108 is AC driven and a picture is displayed.

Each liquid crystal pixel 108 is formed at a position where each pixel electrode 106 and each opposite electrode 107 are oppositely disposed with a liquid crystal layer. Each scanning line 104 is connected to the scanning line driving circuit 121. A scanning pulse is supplied to each scanning line 104. With the scanning pulse, the switching operation of the TFT 105 as the switching device of the pixel portion in the pixel region is controlled. The sample-hold circuits 113 and 114 and the operational amplifiers 116 are 117 are preferably formed as a TFT on the TFT array substrate on which the TFT 105 is formed as the switching device of the pixel portion with the same material as the TFT 105 (for example, polysilicon). At this point, the sample-hold circuits 113 and 114 and the operational amplifiers 116 and 117 may be formed while the TFT 105 as the switching device of the pixel portion is being fabricated.

According to the first embodiment, with such a structure, the power consumption of the external picture signal supplying circuit 109 can be decreased at least to a level where the liquid crystal pixel 108 of the display region 102 is not AC driven.

In addition, since the signal line driving circuit 110 is formed on the TFT array substrate where the TFT 105 is formed with the same material of the TFT 105 in the similar structure thereof, the structure and fabrication process of the signal line driving circuit 110 can be remarkably simplified.

Next, a second embodiment of the present invention will be described.

Figure 3:
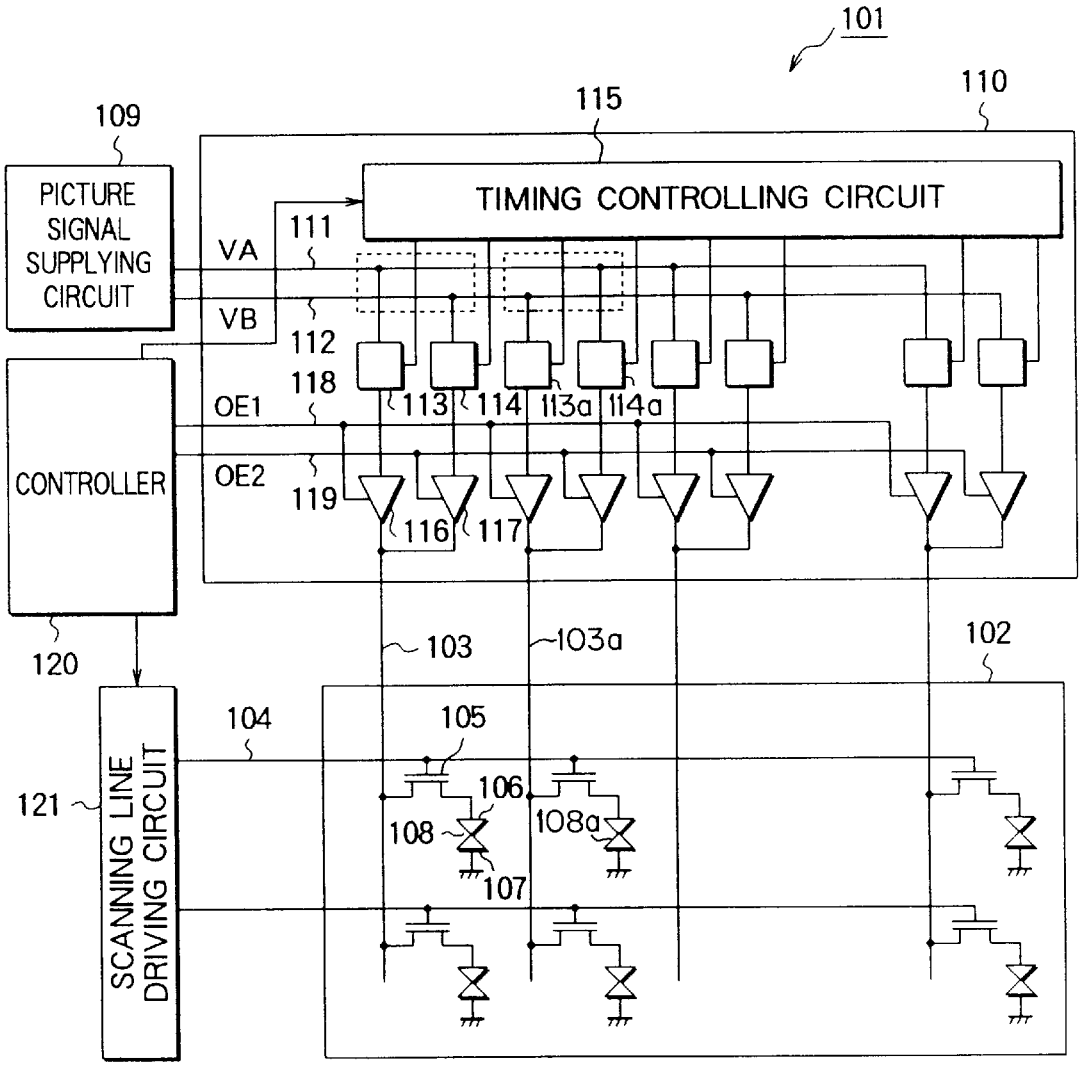
FIG. 3 is a block diagram showing an outlined electric structure of a liquid crystal display apparatus according to a second embodiment of the present invention.

FIG. 3 is a block diagram showing an outlined electric structure of a liquid crystal display apparatus according to the second embodiment of the present invention.

The difference between the liquid crystal display apparatus according to the second embodiment and the liquid crystal display apparatus according to the first embodiment is lines in boxes surrounded by dotted lines. In other words, in the first embodiment, the sample-hold circuit 113 and the line 111 are connected and the sample-hold circuit 114 and the line 112 are connected so that a positive phase picture signal is always input to the sample-hold circuit 113 and a negative phase picture signal is always input to the sample-hold circuit 114. However, in the second embodiment shown in FIG. 3, sample-hold circuits 113 and 114 connected to a particular signal line 103 are connected to lines 111 and 112, respectively. On the other hand, the sample-hold circuits 113*a* and 114*a* connected to a signal line 103*a* adjacent to the particular signal line 103 are connected to lines 112 and 111, respectively.

Thus, in the second embodiment, without necessity of a special controlling operation, the polarity of the picture signal of a particular liquid crystal pixel 108 is different from the polarity of the picture signal of another liquid crystal 108*a* adjacent to the particular liquid crystal pixel 108.

Next, with reference to FIG. 4, a third embodiment of the present invention will be described.

Figure 4:
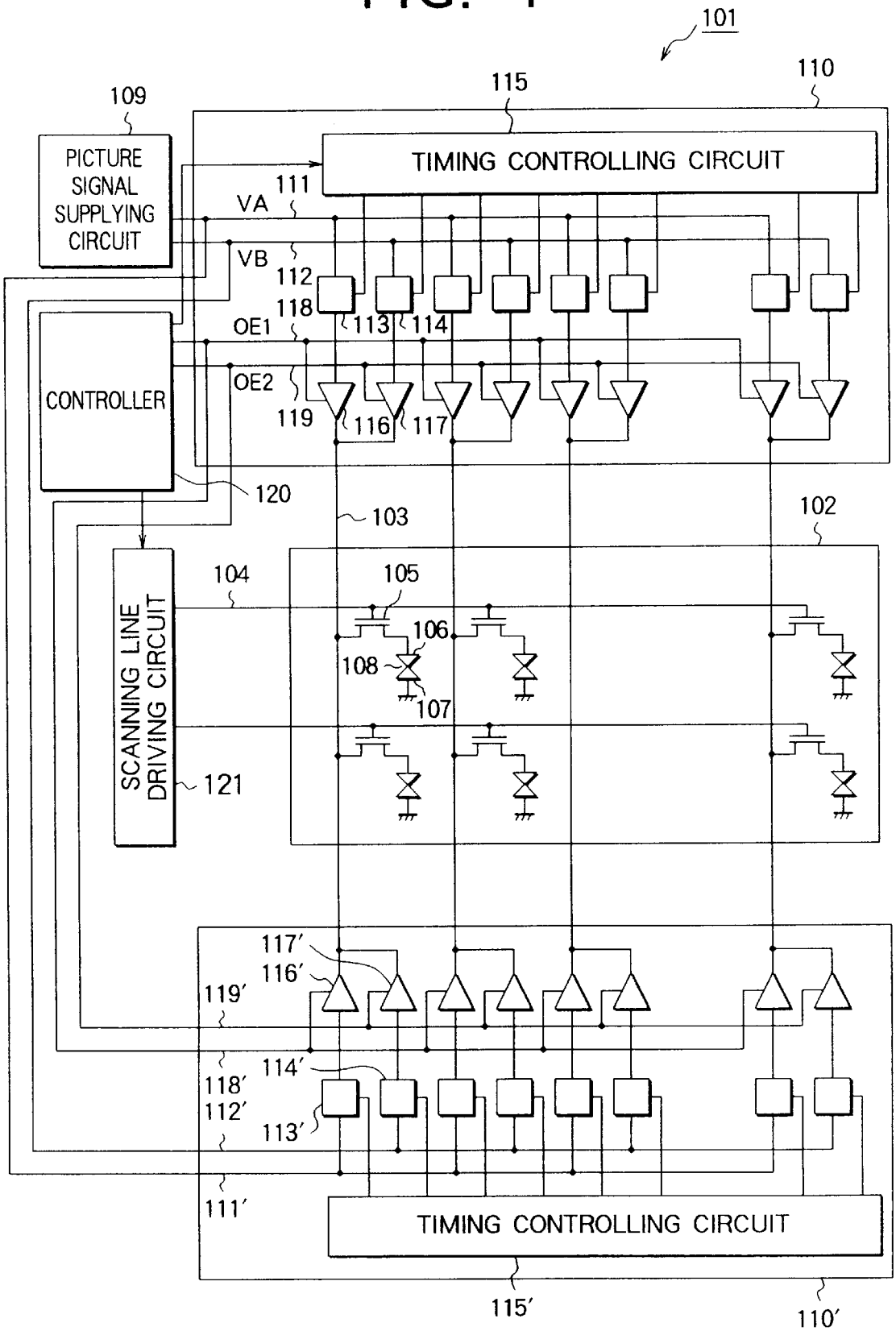
FIG. 4 is a block diagram showing an outlined electric structure of a liquid crystal display apparatus according to a third embodiment of the present invention.

FIG. 4 is a block diagram showing an outlined electric structure of a liquid crystal display apparatus according to the third embodiment of the present invention.

In FIG. 4, a signal line driving circuit 110' that is the same as the signal line driving circuit 110 according to the first embodiment shown in FIG. 1 is also disposed below a display region 102.

For simplicity, in the third embodiment, similar portions to those in the first embodiment are denoted by similar reference numerals.

Lines 111' and 112' that supply an output signal of a picture signal supplying circuit 109 are connected to a signal line driving circuit 110'. In addition, sample-hold circuits 113' and 114' are connected to the lines 111' and 112', respectively. The sample-hold circuits 113' and 114' hold picture signals corresponding to a signal received from the timing controlling circuit 115'. The sample-hold circuits 113' and 114' are connected to the same signal line 103 through operational amplifiers 116' and 117', respectively. The operational amplifiers 116' and 117' are connected to a controlling circuit 120 through lines 118' and 119', respectively.

Thus, the structure and operation the signal line driving circuit 110 are the same as those the signal line driving circuit 110'.

In a conventional liquid crystal display apparatus of where a signal line driving circuit that outputs a positive phase picture signal voltage and a signal line driving circuit that outputs a negative phase picture signal are connected to the upper end and the lower end of one signal line, the same picture signal voltage cannot be written (supplied) to the upper end and the lower end of the signal line at the same time. However, according to the present invention, with the above-described structure, a positive phase picture signal and a negative phase picture signal can be written from the upper end and the lower end of the signal line 103.

Thus, according to the present invention, when the ON resistance of the switching device as in a sample-hold circuit is high or the write time is short, the load for substantially driving a signal line can be halved.

Next, with reference to FIG. 5, a fourth embodiment of the present invention will be described.

Figure 5:
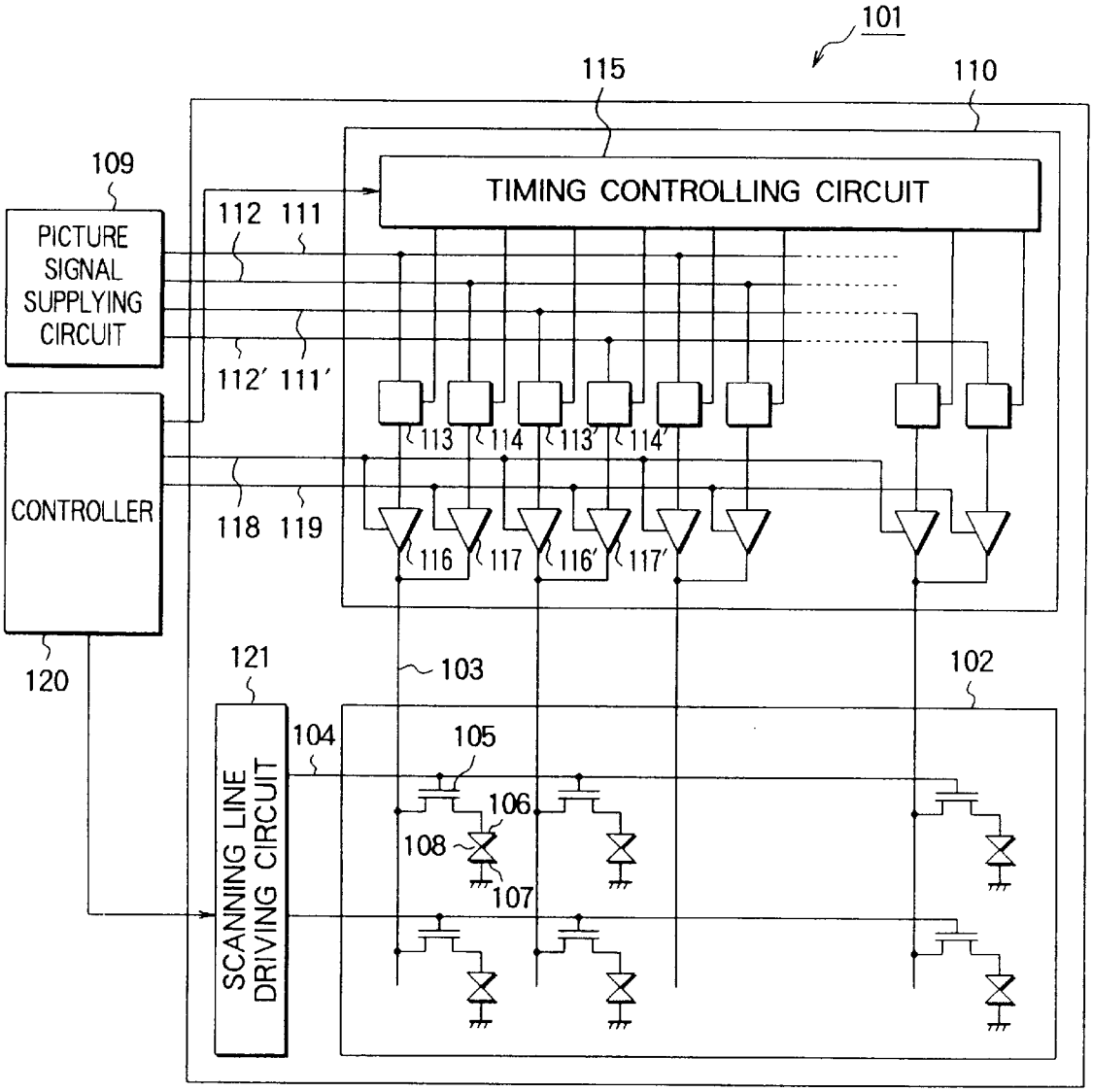
FIG. 5 is a block diagram showing an outlined electric structure of a liquid crystal display apparatus according to a fourth embodiment of the present invention.

FIG. 5 is a block diagram showing an outlined electric structure of a liquid crystal display apparatus according to the fourth embodiment of the present invention. In FIG. 5, the number of driving phases of the signal line driving circuit shown in FIG. 1 is increased to two driving phases. In other words, in the fourth embodiment, a block driving method where signal lines are divided into two blocks is used. For simplicity, in the fourth embodiment, elements similar to those in the first embodiment are denoted by the same reference numerals. As with the embodiment shown in FIG. 3, the block driving method is used to double the substantial write time when the ON resistance of a switching device of the signal line driving circuit is high or the write time is short.

In other words, a picture signal supplying circuit 109 outputs a positive picture signal and a negative picture signal. The positive picture signal is supplied to a signal line driving circuit 110 through lines 111 and 111'. The negative picture signal is supplied to the signal line driving circuit 110 through lines 112 and 112'.

The supplied positive picture signal and the negative picture signal are supplied to sample-hold circuits 113, 113', 114, and 114' of the signal line driving circuit 110. In other words, the positive phase picture signal is supplied to the sample-hold circuits 113 and 113'. The negative phase picture signal is supplied to the sample-hold circuits 114 and 114'. Two adjacent sample-hold circuits 113 and 114 corresponding to the positive phase picture signal and the negative phase picture signal are connected to the same signal line 103 through operational amplifiers 116 and 117, respectively. On the other hand, two adjacent sample-hold circuits 113' and 114' are connected to the same signal line 103' through operational amplifiers 116' and 117', respectively.

The signal line 103 represents a signal line with an odd number counted from the left in FIG. 5. On the other hand, the signal line 103' represents a signal line with an even number counted from the left in FIG. 5.

The sample-hold circuits 113, 113', 114, and 114' hold respective picture signals corresponding to a signal received from a timing controlling circuit 115. The signal lines 103 and 103' of the display region 102 are treated as one block. Each block is individually controlled to alternately supply the positive phase picture signal and the negative phase picture signal and drive the liquid crystal pixel 108. At this point, the odd numbered signal lines 103 and the even numbered signal lines 103' are independently driven as different blocks, the number of driving phases becomes two. Consequently, the substantial write time can be doubled.

In addition, since adjacent lines 111, 112, 111', and 112' carry inverse phase picture signals the, noise of each line can be canceled with inverse phase of the adjacent line. Thus, a picture can be displayed the a high quality.

When a picture signal is divided into a positive phase picture signal and a negative phase picture signal, and the separated picture signals are supplied from an external picture signal supplying circuit to a liquid crystal display apparatus through respective lines, and the positive phase picture signal and the negative phase picture signal are controlled by respective switching devices, two signal line driving circuits 103 can be symmetrically disposed in the vertical direction.

In addition, it should be noted that even if the number of driving phases is three or more, the above-described effects can be obtained.

Figure 6:
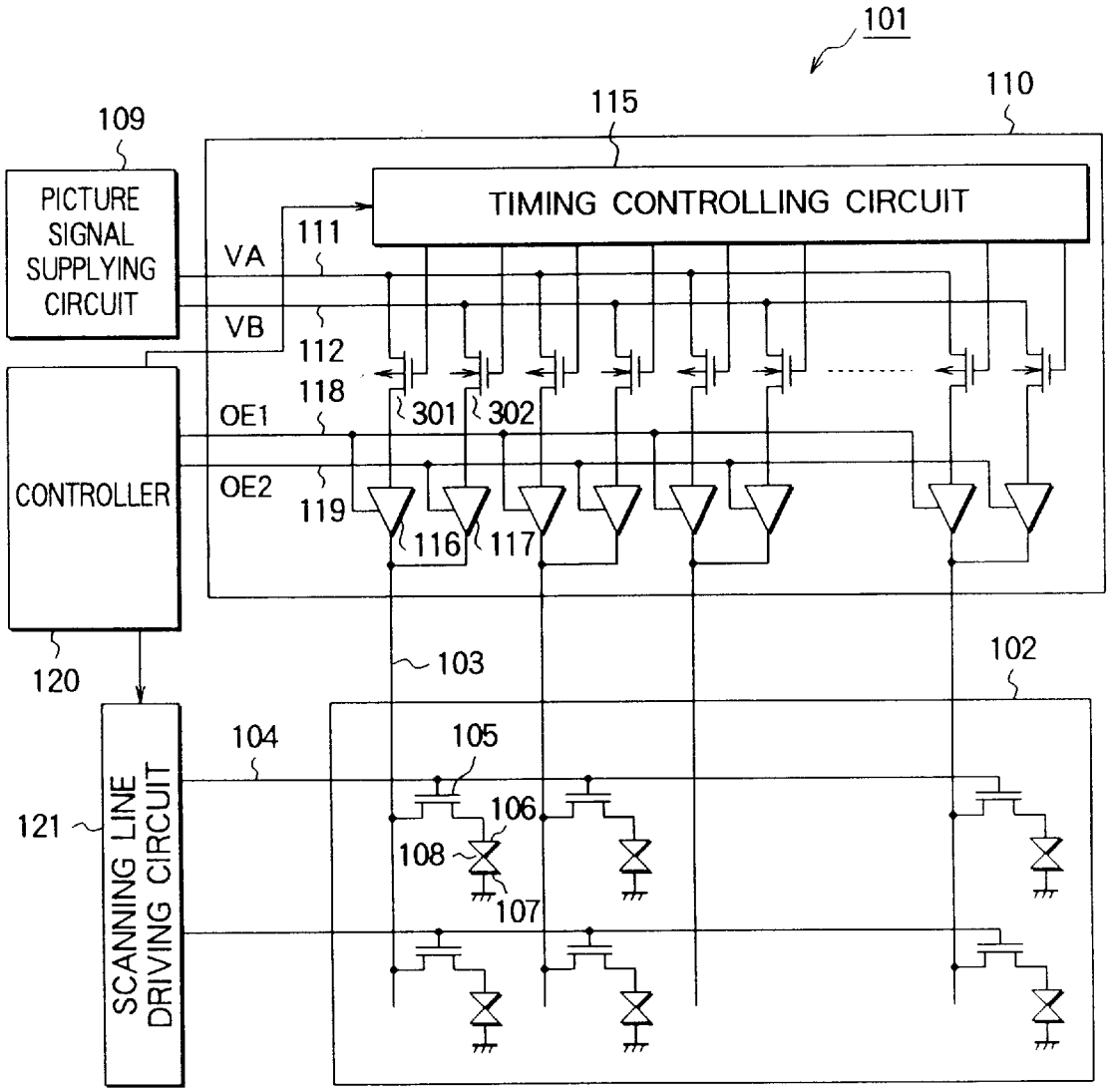
FIG. 6 is a block diagram showing an outlined electric structure of a liquid crystal display apparatus according to a fifth embodiment of the present invention.

FIG. 6 is a block diagram showing an outlined electric structure of a liquid crystal display apparatus according to a fifth embodiment of the present invention. For simplicity, in the fifth embodiment, elements similar to those in the first embodiment are denoted by the same reference numerals.

Switching devices of a signal line driving circuit 110 are composed of MOS type transistors. A positive phase picture signal is controlled by a p-type MOS transistor 301. A negative phase picture signal is controlled by an n-type MOS transistor 302.

Thus, in such a structure, when the resistance of a switching device of a positive phase picture signal is almost the same as that of a negative phase picture signal, a picture signal can be written. In addition, since a picture signal can be held in a high OFF resistance region of the liquid crystal pixel 108, unevenness of pictures can be much more reduced than before.

With the technology of the fifth embodiment, switching devices that do not have high performance can be used. Thus, the present invention can be preferably used for a liquid crystal display apparatus of which switching devices in the signal line driving circuit 110 are formed on the same TFT array substrate of the signal lines 103, the scanning lines 104, and the pixel switching devices 105.

Figure 7:
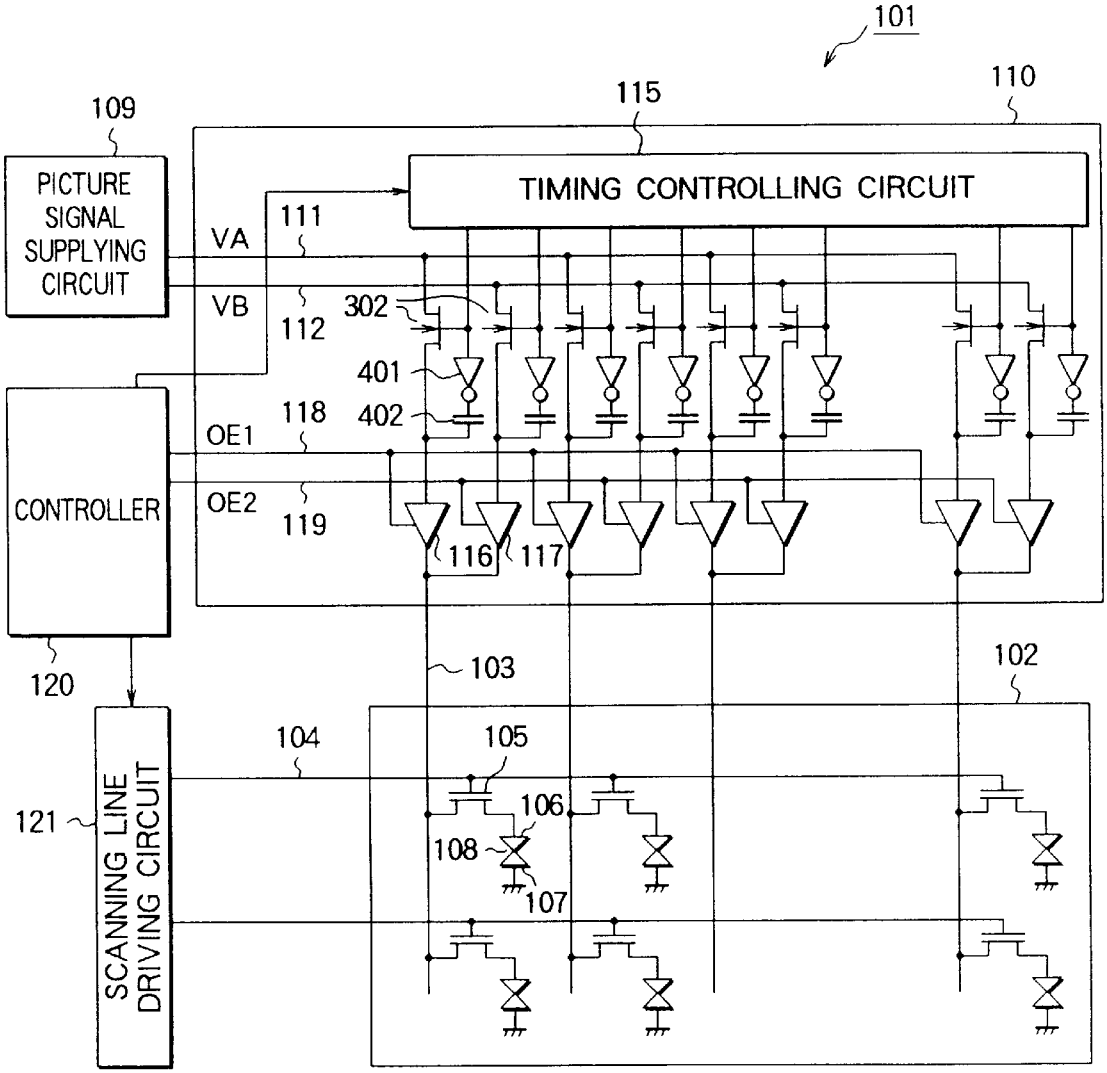
FIG. 7 is a block diagram showing an outlined electric structure of a liquid crystal display apparatus according to a sixth embodiment of the present invention.

FIG. 7 is a block diagram showing an outlined electric structure of a liquid crystal display apparatus according to a sixth embodiment of the present invention. For simplicity, in the sixth embodiment, elements similar to those in the first embodiment are denoted by the same reference numerals.

Each switching device in a signal line driving circuit 110 is composed of an n-type MOS transistor 302.

The MOS transistor 302 is connected through an inverter device 401 to a capacitor 402 to which a signal voltage with an inverse polarity of the gate driving signal voltage is supplied.

The polarity of a gate drive signal voltage of each MOS transistor 302 is inverted by the inverter device 401. The gate drive signal voltage with the inverse polarity is supplied to the capacitor 402.

In such a structure with the capacitor 402, due to a supply of negative electric charges from the capacitor 402, the level shift voltage that takes place when the gate of the MOS transistor 302 is opened or closed can be reduced.

Next, with reference to FIG. 8, a seventh embodiment will be described.

Figure 8:
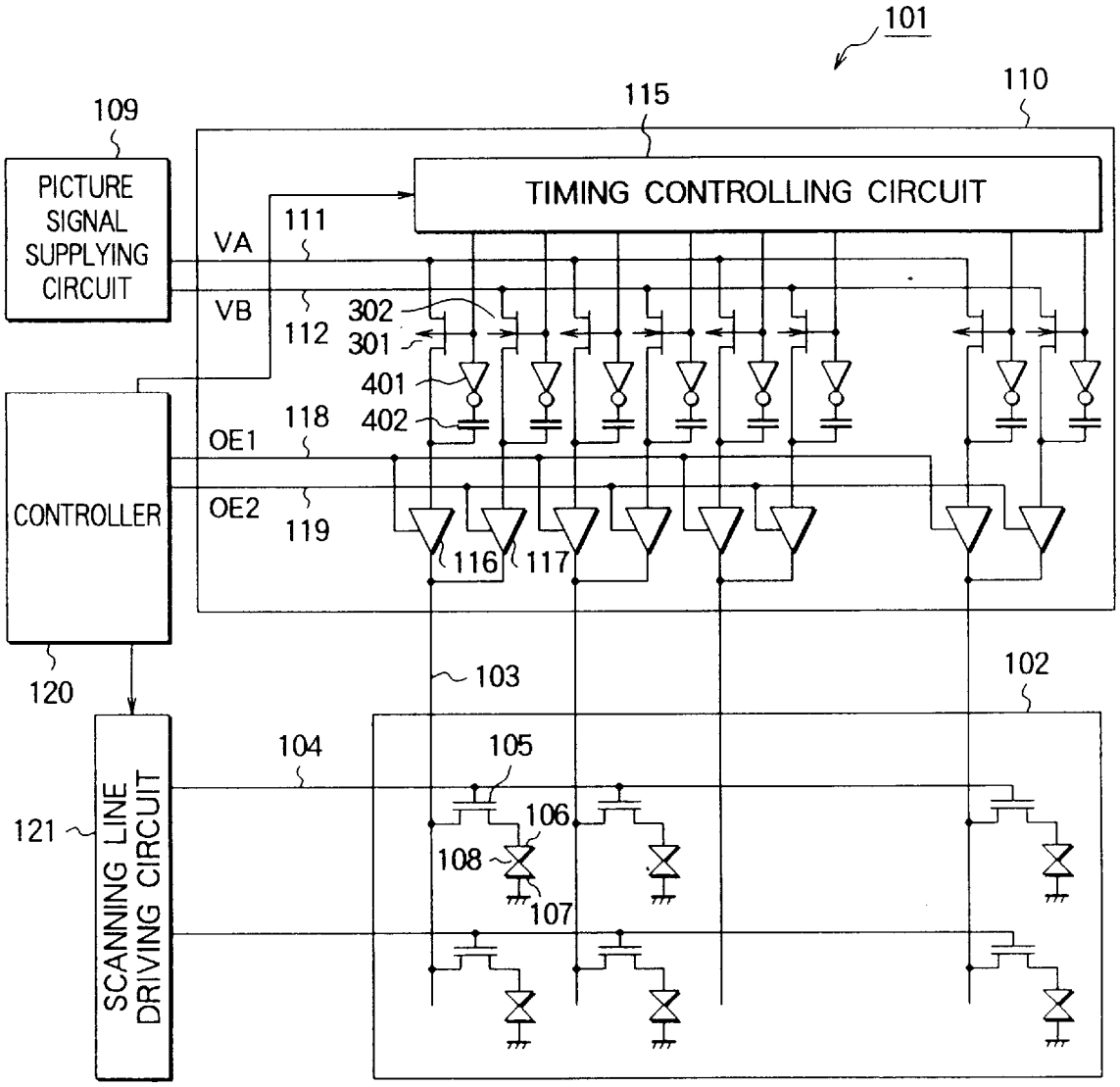
FIG. 8 is a block diagram showing an outlined electric structure of a liquid crystal display apparatus according to a seventh embodiment of the present invention.

FIG. 8 is a block diagram showing an outlined electric structure of a liquid crystal display apparatus according to the seventh embodiment of the present invention. In FIG. 8, a signalling driving circuit 110 having capacitors 403*a* and 403*b* that are similar to the capacitor 402 of the sixth embodiment shown in FIG. 7 is used in a liquid crystal display apparatus having a p-type MOS transistor 301 and an n-type MOS transistor 302. For simplicity, in the seventh embodiment, elements similar to those in the first embodiment are denoted by the same reference numerals.

Even if the polarity of a MOS transistor as a switching device is a p-type, the gate electrode driving polarity varies depending on the type n or p, and the polarity of the signal voltage that drives the capacitor 403*a* of the p-type MOS transistor 301 varies corresponding to the type thereof. The polarity of electric charges for compensating the level shift voltage supplied from the capacitor 403*a* becomes the inverse polarity of the capacitor 403*b* of the n-type MOS transistor 403*a*. Thus, in the seventh embodiment, even in a liquid crystal display apparatus with a structure having a p-type MOS transistor 301 and an n-type MOS transistor 302, as with the structure using for example only n-type MOS transistors, the level shift voltage can be reduced.

Figure 9:
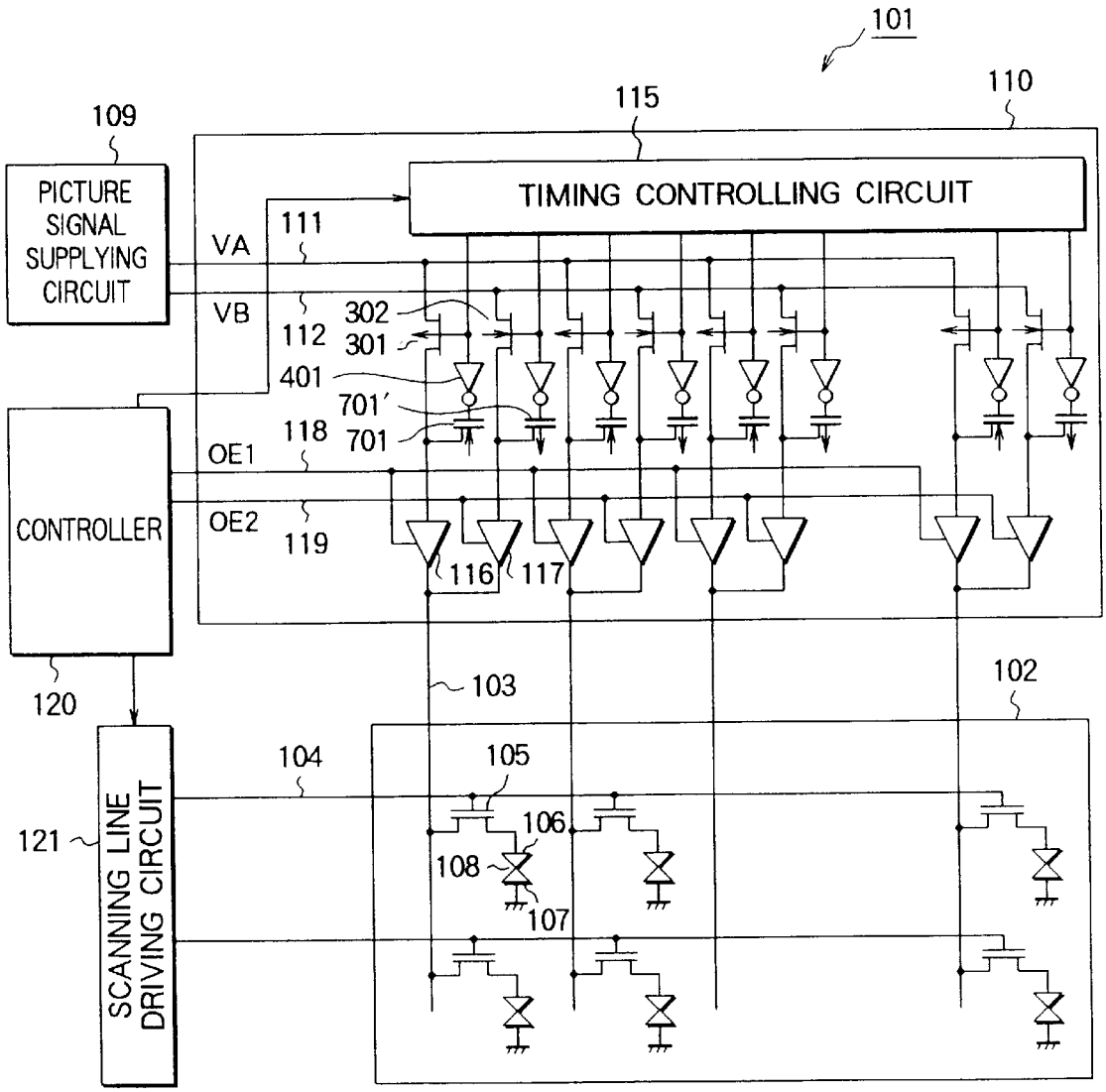
FIG. 9 is a block diagram showing an outlined electric structure of a liquid crystal display apparatus according to an eighth embodiment of the present invention.

FIG. 9 is a block diagram showing an outlined electric structure of a liquid crystal display apparatus according to a seventh embodiment of the present invention.

In FIG. 9, MOS transistors 701*a* and 701*b* are disposed instead of the capacitors 403*a* and 403*b*. Channel capacitance of the MOS transistors 701 and 701*b* is used as capacitors 403*a* and 403*b*, respectively.

The p-type transistor 301 has the channel capacitance of the n-type MOS transistor 701*a*. The n-type transistor 302 has the channel capacitance of the p-type MOS transistor 701*b*.

In this structure, the capacitance similar to the gate capacitance of the MOS transistor that is a cause of the level shift voltage can be used to compensate the level shift voltage. Thus, the level shift voltage of the switching device can be more precisely compensated. Consequently, the level shift voltage can be decreased at least to the level of which the switching device is the transfer gate type.

As long as the capacitance that compensates the various level shift voltages supplies electric charges for decreasing the level shift voltage, the capacitance and the electrode of the channel capacitor are not specified. In addition, as long as a signal with an inverse polarity of a signal for driving an MOS transistor can be obtained, as described in the sixth embodiment, it is not always necessary to obtain a signal for driving a capacitor through an inverter from the gate drive signal of the MOS transistor.

The present invention is not limited to the above-described embodiments. In an active matrix type liquid crystal display apparatus that successively drives a signal line, as long as a liquid crystal display apparatus of which signal lines and pixel electrodes in a display region are AC driven, each of the driving circuits may be disposed above and below the display region. In addition, the number of drive phases may be two or more. Even if the circuit structure of the timing control circuit in the driving circuit, the method for forming the driving circuit, and the method for forming structural devices and driving circuits are different from those of the above-described embodiments, as long as the liquid crystal display apparatus operates in the same manner as those of the above-described embodiments, the same effects can be obtained.

Thus, as described above, according to the present invention, the power consumption of the external picture signal supplying circuit can be decreased at least to the level to which the picture signal is not AC driven. In addition, a positive phase picture signal and a negative picture signal can be written from upper and lower ends of a signal line. Moreover, the low power consumption can be accomplished with a simple structure. In addition, a liquid crystal display apparatus with a high quality display performance free of uneven pictures can be provided.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A driving circuit for driving a display apparatus, comprising:

a first common line to which a positive phase picture signal is input;

a second common line to which a negative phase picture signal is input;

a first switch device group connected to said first common line and adapted for sampling said positive phase picture signal;

a second switch device group connected to said second common line and adapted for sampling said negative phase picture signal;

a timing control circuit for controlling switching operation of said first switch device group and said second switch device group;

first output enable means in common with said first switch device group; and second output enable means in common with said second switch device group, wherein a common control signal is input from said timing control circuit to a switch device pair containing a first switch device and a second switch device from said first and second switch device groups, and either said positive phase picture signal or said negative phase picture signal is output from one of the first switch device and the second switch device enabled by said first output enable means or said second output enable means.

2. The driving circuit for driving the display apparatus as set forth in claim 1, wherein output signals of the pair of the first switch device and the second switch device are successively output corresponding to a control signal that is output from said timing control circuit.

3. The driving circuit for driving the display apparatus as set forth in claim 1, wherein each of said first common line and said second common line is composed of a plurality of lines to form first and second common line groups.

4. The driving circuit for driving the display apparatus as set forth in claim 3, wherein lines composing said first common line group and lines composing said second common line group are alternately disposed.

5. The driving circuit for driving the display apparatus as set forth in claim 1, wherein the switch device is composed of a MOS transistor.

6. The driving circuit for driving the display apparatus as set forth in claim 5, wherein a positive phase picture signal is input from said first common line to a first switch device composing the switch device pair, wherein a negative phase picture signal is input from said second common line to a second switch device composing the switch device pair, wherein said first switch device is composed of a p-ch MOS transistor, and wherein said second switch device is composed of an n-ch MOS transistor.

7. The driving circuit for driving the display apparatus as set forth in claim 5, wherein a capacitor device is connected in series to an output of the MOS transistor, and wherein a voltage with an inverse polarity of a voltage that is input to the MOS transistor is supplied to the capacitor device.

8. The driving circuit for driving the display apparatus as set forth in claim 7, wherein the gate of the MOS transistor and the capacitor device are electrically connected through an inverter.

9. The driving circuit for driving the display apparatus as set forth in claim 1, wherein the polarity of an output signal of one of a pair of adjacent switch devices is the inverse of the polarity of an output signal of the other of the pair.

10. The driving circuit for driving the display apparatus as set forth in claim 9, wherein a first common output enable signal is supplied to a first switch device of the pair connected to a first common line to which a positive phase picture signal is input and to a second switch device of the pair connected to a second common line to which a negative phase picture signal is input, and wherein a second common output enable signal is supplied to the first switch device of the pair connected to the second common line to which the negative phase picture signal is input and to the second switch device of the pair connected to the first common line to which the positive phase picture signal is input.

11. A display apparatus, comprising:

a first common line to which a positive phase picture signal is input;

a second common line to which a negative phase picture signal is input;

a first switch device group connected to said first common line and adapted for sampling said positive phase picture signal;

a second switch device group connected to said second common line and adapted for sampling said negative phase picture signal;

a timing control circuit for controlling switching operation for said first switch device group and said second switch device group;

a driving circuit having first output enable means in common with said first switch device group and second output enable means in common with said second switch device group; and a plurality of display signal lines disposed corresponding to each of said switch device pairs and a plurality of pixels connected thereto, wherein a common control signal is input from said timing control circuit to a switch device pair containing a first switch device and a second switch device from said first and second switch device groups, and either said positive phase picture signal or said negative phase picture signal is output from a switch device enabled means or said second output enable means.

12. The display apparatus as set forth in claim 11, wherein the switch device is composed of a MOS transistor.

13. The display apparatus as set forth in claim 11, wherein each of said pixels has an MOS transistor for sampling a picture signal supplied to the display signal line, and wherein the MOS transistor of the driving circuit is fabricated in the same process as the MOS transistor of each of said pixels.

14. The display apparatus as set forth in claim 11, wherein said driving circuit is disposed at each of the display signal line, and wherein picture signals that are substantially the same are supplied from said driving circuits to the display signal line.

15. A driving circuit for driving a display apparatus, comprising:

picture signal supplying means for supplying a positive phase picture signal and a negative phase picture signal;

a first common line to which said positive phase picture signal is supplied;

a plurality of first switch devices connected to said first common line and adapted for sampling the positive phase picture signal;

a plurality of second switch devices connected to said second common line and adapted for sampling the negative phase picture signal, wherein said first and second switch devices form a plurality of switch device pairs, each switch device pair containing at least one each of said first and second switch devices;

a plurality of lines for commonly connecting the output of one of said first and said second switch devices in each switch device pair and the output of the other of said first and said second switch devices in each switch device pair;

first output enable means disposed between each of said first switch devices and each of said lines and commonly connected to each of said first switch devices;

second output enable means disposed between each of said second switch devices and each of said lines and commonly connected to each of said second switch devices;

first controlling means for controlling switching operations of said first switch devices and said second switch devices corresponding to a control signal in common with each of said switch device pairs; and second controlling means for controlling enable states of said first output enable means and said second output enable means so that one of said first and second switch devices in the switch device pair is output to said lines at predetermined periods.

16. A display apparatus comprising:

a first common line to which a positive phase picture signal is input;

a second common line to which a negative phase picture signal is input;

a timing control circuit for controlling the sampling of positive phase and negative phase picture signals input to said first and second common lines;

a signal line:

an output circuit with which said sampled positive and negative phase picture signals are supplied to the signal line alternately; and a plurality of pixels electrically connected to the signal line.

17. The display apparatus as set forth in claim 16, wherein the output circuit has a plurality of switch devices which sample the picture signals that input to said first and second common lines, and a plurality of enable devices which connect the switch device with the signal line.

* * * * *